US005678909A

United States Patent [19]

Cheng et al.

[11] Patent Number: 5,678,909

[45] Date of Patent: Oct. 21, 1997

[54] DRAWER

[76] Inventors: Yung Sheng Cheng; Kui-Chuan Sung, both of P.O. Box 82-144, Taipei, Taiwan

[21] Appl. No.: 635,730

[22] Filed: Apr. 22, 1996

[51] Int. Cl.[6] ..... A47B 88/00

[52] U.S. Cl. ..... 312/348.2; 312/348.1

[58] Field of Search ..... 312/330.1, 348.2, 312/348.1, 348.4, 257.1, 263

[56] References Cited

U.S. PATENT DOCUMENTS

| | | | |
|---|---|---|---|
| 3,282,635 | 11/1966 | Himelreich | 312/330.1 |
| 3,556,626 | 1/1971 | Schock | 312/348.1 |
| 4,099,815 | 7/1978 | Cox et al. | 312/348.2 |
| 4,108,520 | 8/1978 | Litchfield | 312/348.2 |

FOREIGN PATENT DOCUMENTS

| | | | |
|---|---|---|---|
| 0425447 | 5/1991 | European Pat. Off. | 312/330.1 |
| 1410377 | 10/1975 | United Kingdom | 312/348.2 |

*Primary Examiner*—Peter M. Cuomo
*Assistant Examiner*—Gerald A. Anderson
*Attorney, Agent, or Firm*—Alfred Lei

[57] ABSTRACT

A drawer including four connecting angle plates to connect an upright front board, and upright back board, two upright side boards, and a horizontal bottom board together, wherein each of the connecting angle plates has a first longitudinal mounting groove longitudinally disposed at an inner side along the bottom adapted for mounting the horizontal bottom board, a second longitudinal mounting groove longitudinally disposed at an outer side in the middle adapted for coupling to a sliding track in the table, desk, etc., in which the drawer is installed, a first coupling hole at one end and a second coupling hole at an opposite end adapted for receiving the upright front and back boards and the upright side boards by plug joints; the upright front and back boards and the upright side boards are respectively cut from an elongated plastic base board, each having a first longitudinal mounting groove longitudinally disposed at an inner side along the bottom adapted for mounting the horizontal bottom board, and a second longitudinal mounting groove longitudinally disposed at an outer side in the middle adapted for coupling to a sliding track in the table, desk, etc., in which the drawer is installed.

2 Claims, 6 Drawing Sheets

DRAWER

BACKGROUND OF THE INVENTION

1. Field of the Invention

This invention relates to drawers, and in particular to a plastic drawer which is assembled by using four connecting angle plates to connect an upright front board, an upright back board, two upright side boards, and a horizontal bottom board together.

2. Description of the Prior Art

Regular drawers are commonly made from wooden plates, comprised of two upright side panels, an upright front panel, an upright back panel, a horizontal bottom panel, and a face panel. These panels are fastened to one another by dovetail joints or screws. Because wooden material is difficult and expensive to obtain and cutting trees in order to obtain wooden material will destroy the relation of living things to their environment, it is economic to make drawers from wooden material. Furthermore, only experienced, skillful artisan can make drawers from wooden material because a series of procedures including cutting, planing, boring, nailing, etc. must be employed. While nailing, the structure of wooden plates may be damaged, causing the wooden plates to crack. In order to eliminate the aforesaid drawbacks, plastic drawers have been developed. Regular plastic drawers are made by fastening a plurality of plastic members together. However, these plastic members are separately injection molded from plastic. Therefore, the molding cost is high.

SUMMARY OF THE INVENTION

This invention relates to drawers, and in particular to a plastic drawer which is assembled by using four connecting angle plates to connect an upright front board, an upright back board, two upright side boards, and a horizontal bottom board together.

According to the present invention, the drawer includes four connecting angle plates to connect an upright front board, an upright back board, two upright side boards, and a horizontal bottom board together, wherein each of the connecting angle plates has a first longitudinal mounting groove longitudinally disposed at an inner side along the bottom adapted for mounting the horizontal bottom board, a second longitudinal mounting groove longitudinally disposed at an outer side in the middle adapted for coupling to a sliding track in the table, desk, etc., in which the drawer is installed, a first coupling hole at one end and a second coupling hole at an opposite end adapted for receiving the upright front and back boards and the upright side boards by plug joints; the upright front and back boards and the upright side boards are respectively cut from an elongated plastic base board, each having a first longitudinal mounting groove longitudinally disposed at an inner side along the bottom adapted for mounting the horizontal bottom board, and a second longitudinal mounting groove longitudinally disposed at an outer side in the middle adapted for coupling to a sliding track in the table, desk, etc., in which the drawer is installed. Because the connecting angle plates are identical, and the upright front and back boards and the upright side boards are respectively cut from a plastic base board, the manufacturing cost of the drawer is low.

DETAILED DESCRIPTION OF THE PREFERRED EMBODIMENT

Figure 1:
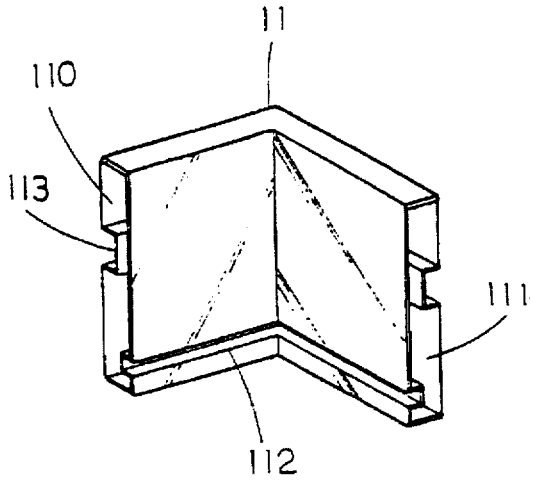
FIG. 1 is an elevational view of a connecting angle plate according to the first embodiment of the present invention.

For the purpose of promoting an understanding of the principles of the invention, reference will now be made to the embodiment illustrated in the drawings. Specific language will be used to described same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 4:
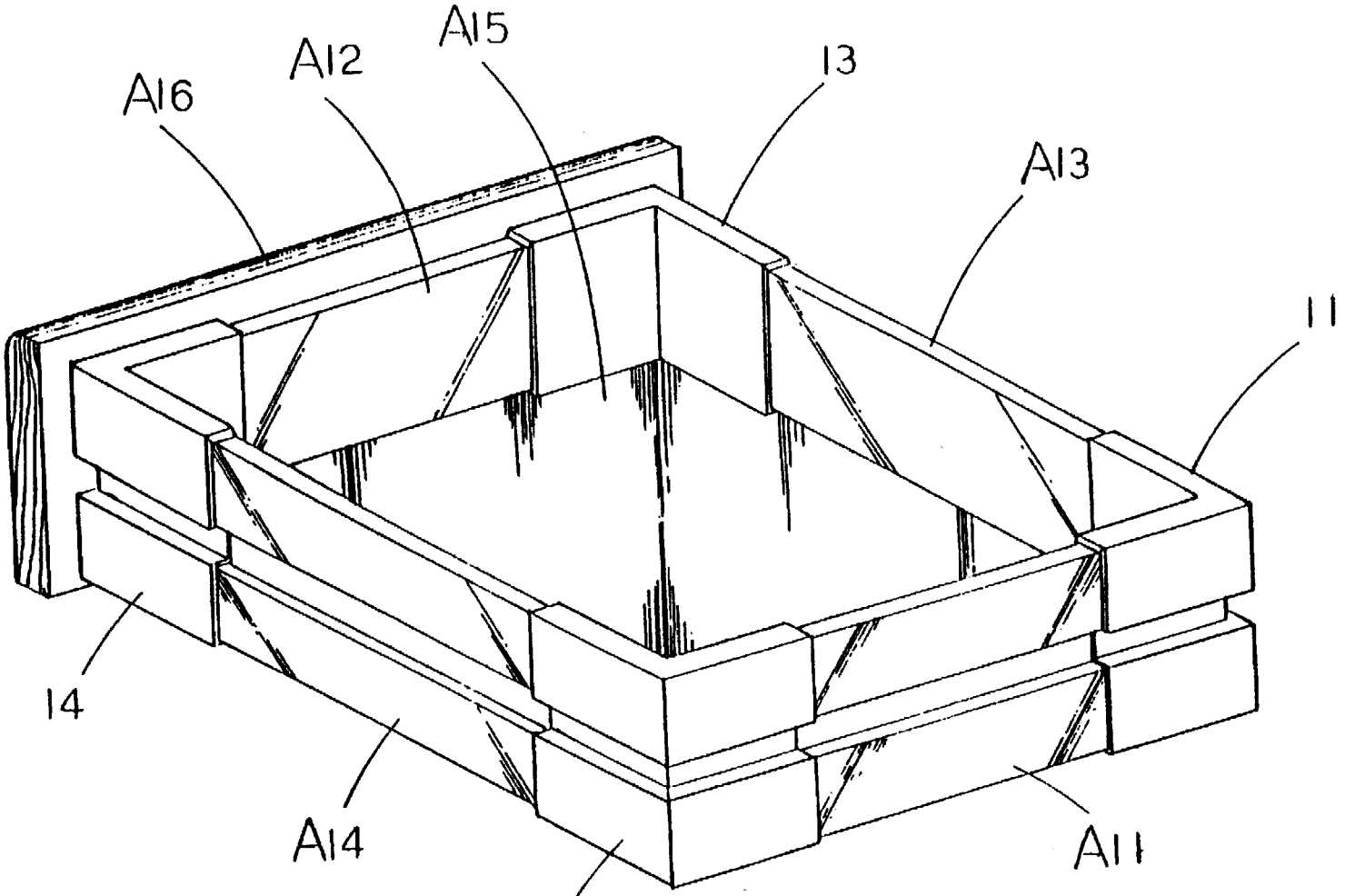
FIG. 4 is an elevational view of a drawer according to the first embodiment of the present invention.
Figure 5:
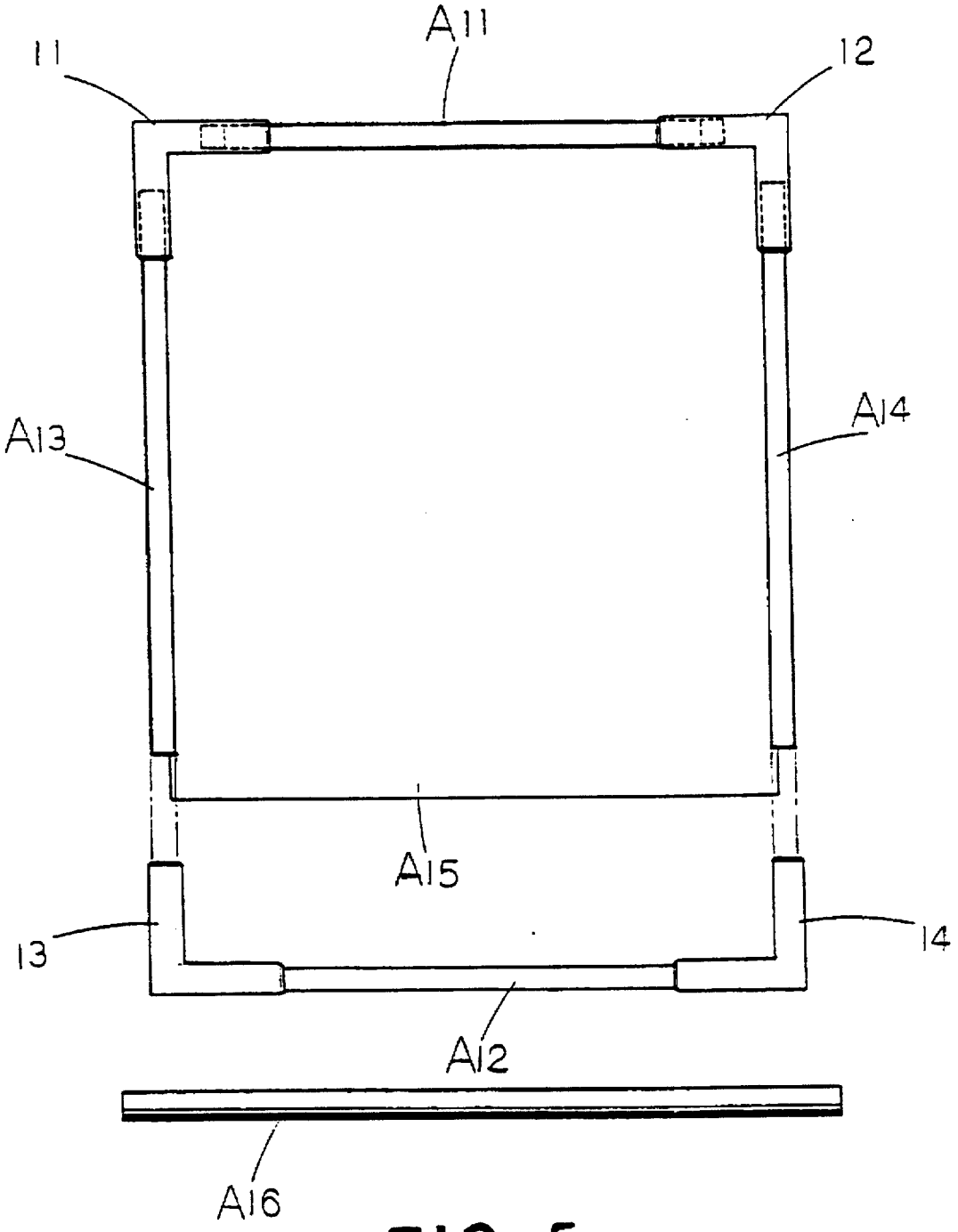
FIG. 5 is a top view of the first embodiment of the present invention.

Referring to FIGS. 4 and 5, a drawer in accordance with the present invention is generally comprised of an upright front board A12, an upright back board A11, two upright side boards A13, A14 connected in parallel between the upright front board A12 and the upright back board A11, four connecting angle plates 11, 12, 13, 14 respectively disposed at the four angles to connect the upright front board A12, the upright back board A11, and the upright side boards A13, A14 together, a horizontal bottom board A15 mounted within the upright front and back boards A12, A11 and the upright side boards A13, A14 at the bottom side, and an upright face panel A16 fixed to the upright front board A12 and the two corresponding connecting angle plates 13, 14. The upright front board A12 and the upright back board A11 are identical. The upright side boards A13, A14 are identical.

Figure 2:
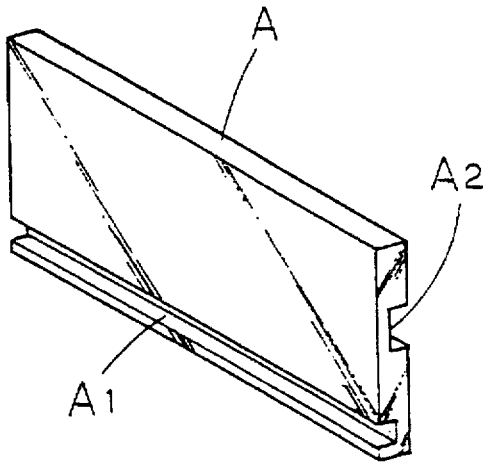
FIG. 2 is an elevational view of an elongated plastic base board according to the first embodiment of the present invention.
Figure 3:
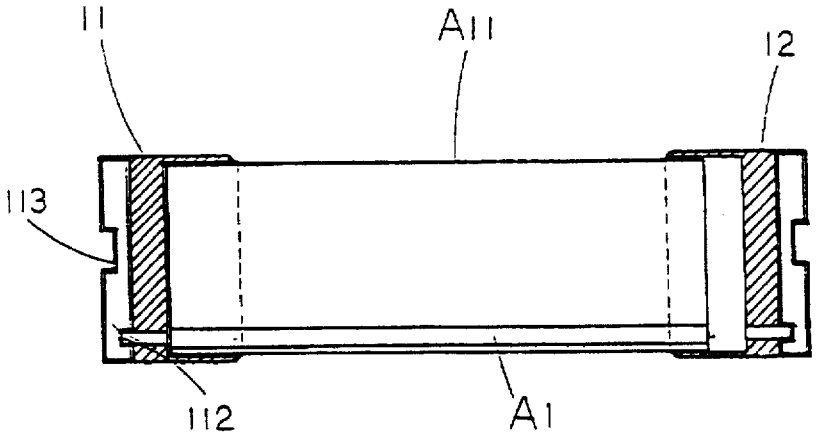
FIG. 3 is a sectional view showing two connecting angle plates fastened to the two opposite ends of the upright back board according to the first embodiment of the present invention.

Referring to FIGS. 1, 2, and 3, and FIG. 4 again, the upright front and back boards A12, A11 and the upright side boards A13, A14 are respectively cut from an elongated base board A which is integrally injection molded from plastic. As illustrated in FIG. 2, the base board A has a first longitudinal mounting groove A1 longitudinally disposed at an inner side along the bottom, and a second longitudinal mounting groove A2 longitudinally disposed at an outer side in the middle. The connecting angle plates 11, 12, 13, 14 are identical. As illustrated in FIG. 1, the connecting angle plate 11 comprises a first coupling hole 111 at one end, a second coupling hole 113 at an opposite end, a first longitudinal mounting groove 112 longitudinally disposed at an inner side along the bottom, and a second longitudinal mounting groove 113 longitudinally disposed at an outer side in the middle. By fitting the boards A11, A12, A13, A14 into the coupling holes 110, 111 of the connecting angle plates 11, the boards A11, A12, A13, A14 and the connecting angle plates 11, 12, 13, 14 are connected together. Before connecting the upright back board A11 with the two corresponding connecting angle plates 11, 12 to the upright side boards A13, A14, the horizontal bottom board A15 is fastened to the first longitudinal mounting grooves A1, 112 of the upright side boards A13, A14, the upright front board A12 and the other two connecting angle plates 13, 14. When the horizontal bottom board A15 is installed, the connecting angle plates 11, 12 are respectively coupled to the upright side boards A13, A14, permitting the horizontal bottom board A15 to be forced into engagement with the first longitudinal mounting grooves A1, 112 of the upright back board A11 and the connecting angle plates 11, 12. Then, the upright face panel A16 is fixedly secured to the upright front board A12 and the connecting angle plates 13, 14. When the drawer is assembled, the second longitudinal mounting grooves A2 of the upright side boards A13, A14 and the connecting angle plates 11, 12, 13, 14 are longitudinally alinged for mounting on two opposite sliding tracks inside the table, desk, etc. Furthermore, screws or bonding agent may be employed to secure the connection between each two connected members.

Figure 6:
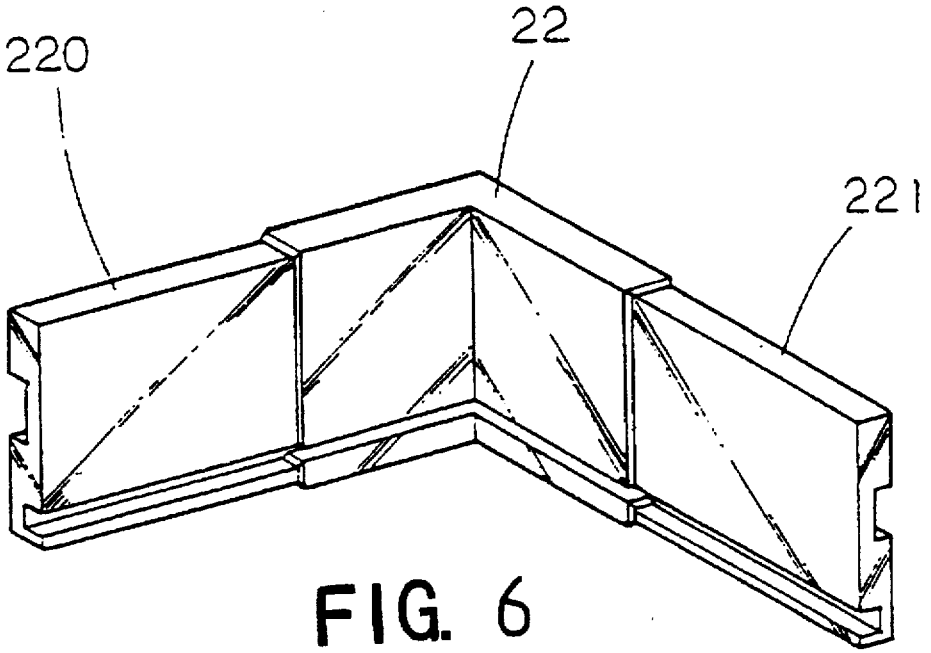
FIG. 6 is an elevational view of a connecting angle plate according to the second embodiment of the present invention.
Figure 7:
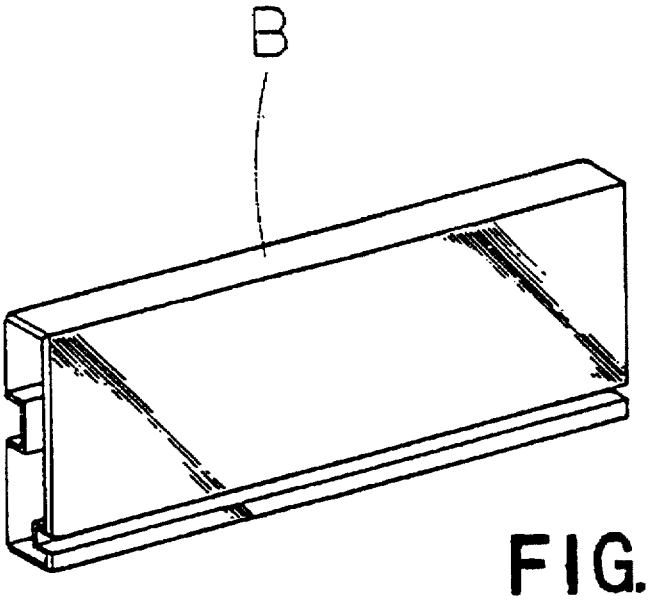
FIG. 7 is an elevational view of an elongated plastic base board according to the second embodiment of the present invention.
Figure 8:
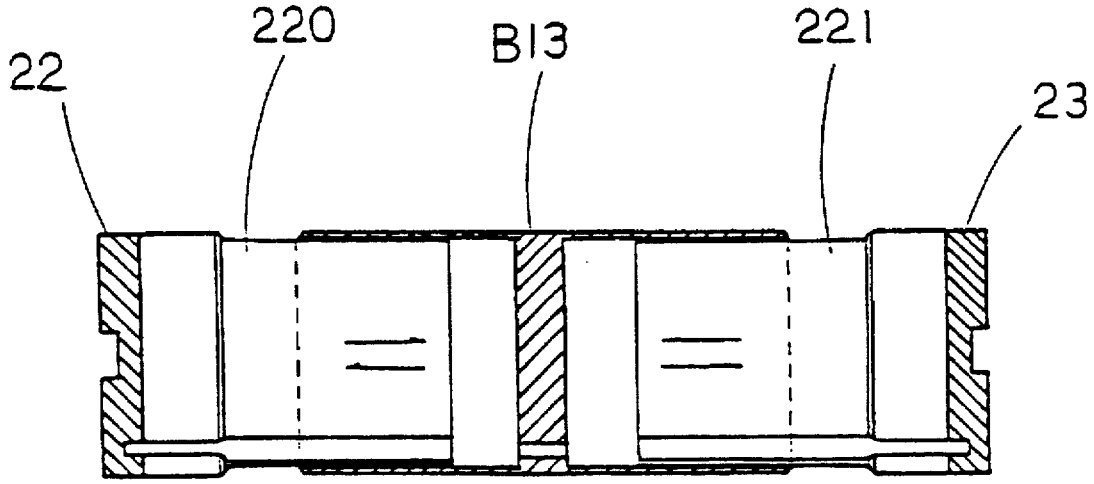
FIG. 8 is a sectional view showing two connecting angle plates fastened to the two opposite ends of the upright front board according to the first embodiment of the present invention.
Figure 9:
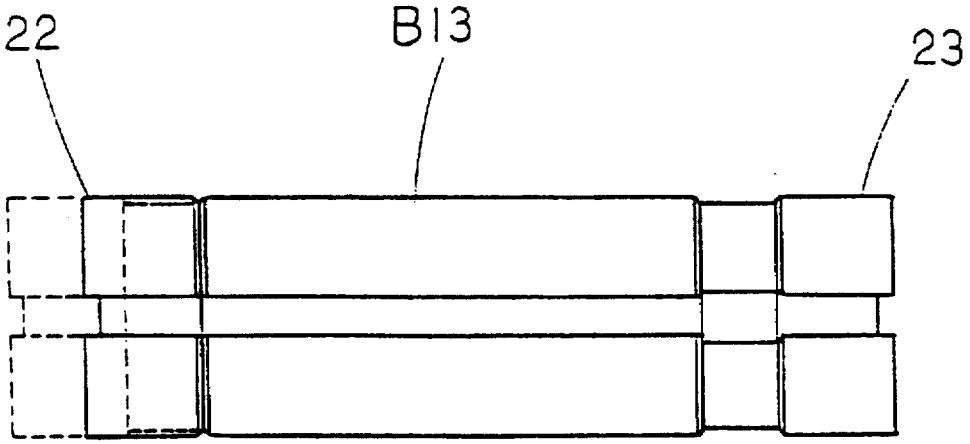
FIG. 9 is a plain view of FIG. 8.
Figure 10:
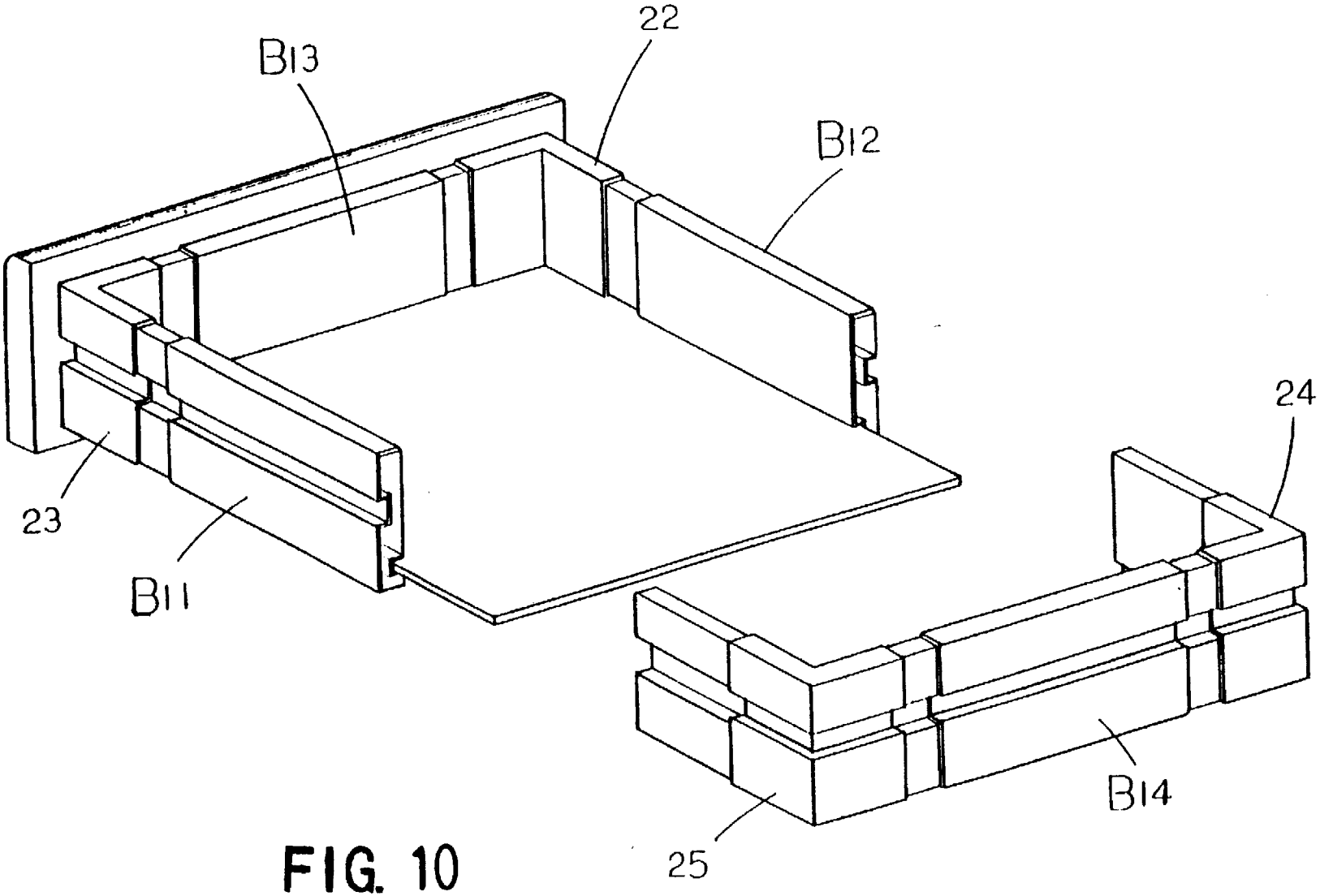
FIG. 10 is an elevational and partially exploded view of the second embodiment of the present invention.

FIGS. from 6 to 10 show an alternate form of the present invention. According to this alternate form, the upright front board B13, the upright back board B14, and the upright side boards B11, B12 are respectively cut from a hollow base board B (see FIG. 7); the connecting angle plate 22, 23, 24, 25 are made of solid structure having two extended coupling portions 220, 221 (see FIG. 6) adapted for fitting into the ends of the boards B11, B12, B13, B14.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A drawer of the type comprising an upright front board, an upright back board, two upright side boards connected in parallel between said upright front board and said upright back board, four connecting angle plates respectively disposed at four angles to connect said upright front board, said upright back board, and said upright side boards together, a horizontal bottom board mounted within said upright front and back boards, said upright side boards and said plates at a bottom side thereof, and an upright face panel fixed to said upright front board and the two corresponding connecting angle plates, wherein said upright front and back boards and said upright side boards are respectively cut from an elongated plastic base board, each of said boards and said plates having a first longitudinal mounting groove longitudinally disposed at an inner side along the bottom side mounting said horizontal bottom board, and a second longitudinal mounting groove longitudinally disposed at an outer side in a middle thereof adapted for coupling to a sliding track in an article of furniture in which the drawer is installed; each of said boards having a first board coupling portion at one board end and a second board coupling portion at an opposite board end and for coupling to each said connecting angle plate having a first plate coupling portion at one plate end and a second plate coupling portion at a opposite plate end, each said board coupling portion coupled to a plate coupling portion by plug joints.

2. The drawer as claimed in claim 1 wherein the first and second coupling portions of said connecting angle plates are female coupling means, the first and second coupling portions of said upright front and back boards and said upright side boards are male coupling means respectively fitted into the female coupling means of said connecting angle plates.

* * * * *